United States Patent [101]

Oltman, Jr.

[11] 4,054,874

[45] Oct. 18, 1977

[54] MICROSTRIP-DIPOLE ANTENNA ELEMENTS AND ARRAYS THEREOF

[75] Inventor: Henry G. Oltman, Jr., Woodland Hills, Calif.

[73] Assignee: Hughes Aircraft Company, Culver City, Calif.

[21] Appl. No.: 585,920

[22] Filed: June 11, 1975

[51] Int. Cl.[2] ..... H01Q 1/38

[52] U.S. Cl. ..... 343/700 MS; 343/797; 343/853

[58] Field of Search ..... 343/754, 846, 854, 700 MS, 343/797, 853

[56] References Cited

U.S. PATENT DOCUMENTS

| | | | |
|---|---|---|---|
| 2,963,703 | 12/1960 | Sletten | 343/911 |
| 3,016,536 | 1/1962 | Fubini | 343/700 MS |
| 3,155,975 | 11/1964 | Chatelain | 343/911 R |
| 3,665,480 | 5/1972 | Fassett | 343/754 |
| 3,680,142 | 7/1972 | Van Atta et al. | 343/770 |
| 3,921,177 | 11/1975 | Munson | 343/854 |
| 3,978,487 | 8/1976 | Kaloi | 343/700 MS |

FOREIGN PATENT DOCUMENTS

| | | | |
|---|---|---|---|
| 1,294,024 | 9/1972 | United Kingdom | 343/700 MS |

*Primary Examiner*—Eli Lieberman

*Attorney, Agent, or Firm*—Lawrence V. Link, Jr.; W. H. MacAllister

[57] ABSTRACT

Herein disclosed are antenna elements comprised of a dipole reactively coupled to a feed line on a microstrip board; and linearly and circularly polarized arrays of such elements.

34 Claims, 27 Drawing Figures

MICROSTRIP-DIPOLE ANTENNA ELEMENTS AND ARRAYS THEREOF

BACKGROUND OF THE INVENTION

This invention relates to antenna elements and particularly to such elements which are formed by means of a dipole reactively coupled to a microstrip line; and to arrays of such elements.

It is generally accepted by antenna designers that a radiating dipole antenna element disposed close to a ground plane and driven by a conventional transmission line will have poor radiation efficiency, and a narrow bandwidth. One reason it has been assumed that the efficiency of such antenna configurations would be low is the general belief that large dipole currents and hence high resistive losses would result from interaction with the radiation reflected from the ground plane. Also, since the fields of the currents which do not radiate are trapped as stored energy it has been assumed that a narrowing of the operational bandwidth of the antenna would result. For example, such a narrowing of the bandwidth would seem to follow from the accepted design equation: $\omega U/P = f/2\alpha f$; where $2\alpha f$ is the bandwidth; $\omega$ is $2\pi f$; U is the stored energy and P is the radiated power. Hence, one would conclude that the bandwidth decreases as the stored power increases, i.e. $2\alpha f \Delta 1/U$.

SUMMARY OF THE INVENTION

A primary object of the subject invention is to provide new and improved antenna elements.

A more specific object is to provide very thin antennas which have relatively high efficiency and bandwidth.

A further object is to provide antennas which are economical to produce.

A still further object is to provide new and improved dipole type antenna elements which are adapted for implementation on microstrip boards so as to form very thin antenna arrays.

Yet another object is to provide a new and improved circularly polarized microstrip-dipole antenna array.

In accordance with the subject invention, microstrip-dipole antenna elements are formed by reactively coupling a dipole to a microstrip line such that the separation between the dipole and the ground plane of the microstrip board is less than one-sixth of a wavelength. Dipole arrays may be formed, for example, by feeding a plurality of dipole elements from a microstrip coporate feed; or several dipoles can be coupled to a single microstrip line to form a linear array and several of these linear arrays can be innercoupled to form a planar antenna array.

The reactive coupling, i.e. by means of electric fields, magnetic fields or both, of the dipole to the microstrip line is fundamental in the realization of broad bandwidth, high gain antenna elements of the subject invention. An impedance match between the dipole and the microwave feed line is readily obtained by adjusting the overlap and/or spacing between the dipole and the line. The relative position of the dipole with respect to the microstrip feed line may be selected over a large range; for example, for a specific longitudinal and lateral position of the dipole relative to the line there will be one height at which the dipole will match the microstrip line. In contrast with prior art impedance transforming devices, e.g. quarter-wave transformers, the subject invention appears to have little bandwidth reducing effect of the dipole transmission line combination. It is estimated that efficiencies as high as 95% may be realized, i.e. 95% of the power fed into the microstrip line is radiated and only 5% is dissipated by resistive losses; and a bandwidth of 8% for single dipole elements and 13% for elements comprising a pair of dipoles may be obtained.

As noted hereinabove, when using the conventional "hardwired" connection of the dipole to its driving transmission line, a nearby ground plane would cause severe problems in impedance matching, and therefore in maximum power transfer; and would produce bandwidth narrowing. In such arrangements, an impedance transformer would be required to impedance match the "hardwired" dipole to its feeding line. Such impedance transformers, e.g. multiple quarter-wave sections, require relative large space to implement and significantly increase costs.

In one embodiment of the invention adapted for transmitting circularly polarized energy, two orthogonally disposed dipoles are reactively coupled to terminals of a corporate feed distribution system such that each dipole is excited with approximately the same amplitude of phase quadrature signals.

In accordance with another embodiment of the subject invention a plurality of dipoles are reactively coupled to each other and to a microstrip line. This configuration allows for an increase in the bandwidth of the dipole antenna by means of the relative coupling of the dipoles to each other and to the microstrip line.

In another arrangement, several dipoles are reactively coupled to a single microstrip line to form a linear array and the relative amount of energy radiated by each of the dipoles is controllable by adjustment of the cross-over position between the microstrip line and the dipole. In this manner any desired illumination taper (relative power distribution pattern) may be obtained.

The advantages provided by the subject invention include low cost, light weight, small thickness, good produceability, high efficiency, high gain and a choice between either circular or linear polarization.

BRIEF DESCRIPTION OF THE DRAWINGS

The novel features of this invention, as well as the invention itself, will be better understood from the accompanying description taken in connection with the accompanying drawings in which like reference characters refer to like parts and in which.

DESCRIPTION OF THE PREFERRED EMBODIMENTS

Figure 1:
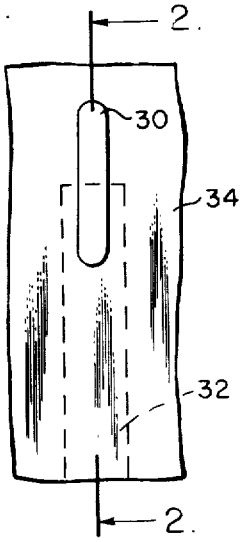
FIGS. 1 and 2 are front and side views, respectively, of a microstrip-dipole antenna element in accordance with the subject invention and wherein the dipole is colinear, above and centered longitudinally with respect to the microstrip line.
Figure 2:
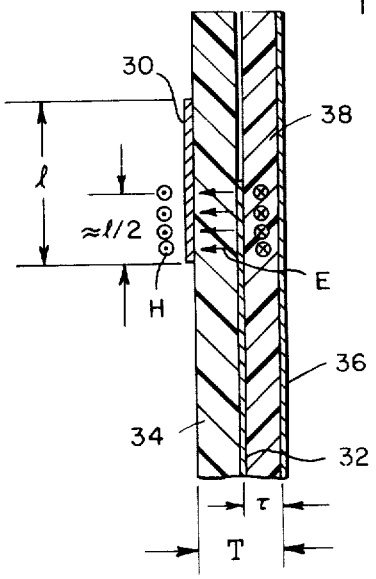

Referring first to FIGS. 1 and 2, the embodiment of the subject invention there shown comprises a dipole element 30 which is disposed relative to a microstrip feed line 32 so that the dipole is reactively coupled to the microstrip line. Dipole 30 is on a printed circuit board 34; and microstrip line 32 is a strip conductor separated from a metallic ground plane 36 by a dielectric layer 38. In FIGS. 1 and 2, dipole 30 is disposed above, colinear with and longitudinally centered with respect to microstrip strip line 32; and the reactive coupling between the microstrip line and the dipole is by means of both electric (E) and magnetic (H) fields. Maximum coupling occurs with approximately 50% overlap of dipole 30 and feed line 32. The thicknesses of the dielectric board and the microstrip board are such that t (see FIG. 2) is approximately between $\lambda/16$ and $\lambda/50$, where $\lambda$ is the wavelength of the operational frequency of the antenna element; and T is approximately between $\lambda/6$ and $\lambda/25$. For the case where the microstrip line is driven from a conventional 50 ohm source, it has been found that maximum power transfer (i.e., the best impedance match) occurs where T is approximately equal to 2.7 t. Both the dipole and the microstrip line may be fabricated by standard photoetching techniques.

The antenna element is operated at or within a band of frequencies which is near the resonant frequency of the dipole. In free space, this resonant frequency would be such that the dipole length is slightly less then $\lambda/2$; however in the embodiments of the subject invention it has been found that the resonant frequency is closer to a frequency which corresponds to a dipole length of approximately $\lambda/3$. This difference in the length of the dipole is believed summarily to be due to the effects of the relative dielectric constant of the dielectric materials, 34 and 38.

In order to couple most of the power incident on the microstrip line into the dipole for subsequent radiation, the dipole must be located close to the microstrip feed line and hence to its ground plane. As noted herein above when using prior art "hardwired" connections between the dipole and its feeding transmission line, the nearness of a ground plane would cause severe problems in impedance matching (complete transfer of power) and produce a narrowing of the operational bandwidth. In accordance with the subject invention, the dipole is reactively coupled to the feeding microstrip line and it is believed that this reactive coupling automatically produces an impedance transformation such that little bandwidth reduction results from the closeness of the dipole to the ground plane of the microstrip board.

The above presented nominal dimensions of the microstrip/dipole antenna element are not intended to be restrictive of other values inasmuch as the range of acceptable dimensions depends on the performance efficiency required in a given application. For larger printed circuit board thicknesses for a given operational frequency, there will be a greater amount of unwanted radiation coming directly from the feed structure discontinuities, i.e., corporate feed junctions etc.; and this radiation will degrade the desired radiation pattern from the dipole. For smaller printed circuit board thickness, there will be more stored energy in the dipole and in its image in the ground plane; and because this energy is partially dissipated in conductor and dielectric loss mechanisms, a larger amount of power will be wasted for smaller thicknesses of the dipole microstrip combination.

Once either of the circuit boards thicknesses is chosen, the other may be determined in accordance with the above presented guidelines and there still remains some latitude because of the varying amounts of overlap between the dipole and microstrip line which are available, e.g. any lateral deviation can be expected to reduce the amount of coupling.

Figure 5:
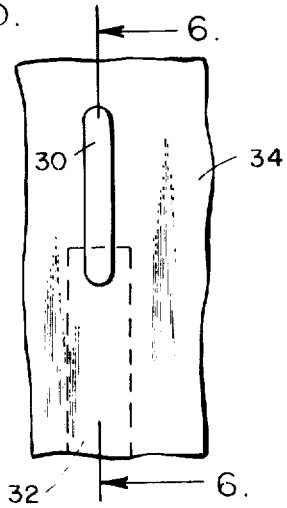
FIGS. 5 and 6 are front and side views, respectively, of a configuration of the invention wherein the dipole element is colinear, above, and slightly overlaps the microstrip line.
Figure 6:
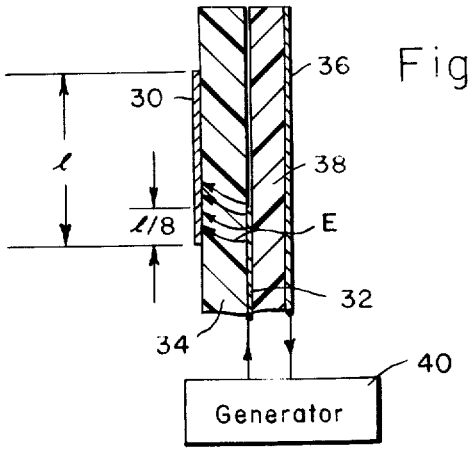

As the overlap between the dipole and the microstrip feed line is reduced such as to the position shown in FIGS. 5 and 6, the amount of magnetic coupling is reduced while the electric coupling remains strong and as a result, the dipole must be brought closer to the feed line in order to maintain maximum power transfer. For any chosen board thickness, the position of the dipole for maximum power transfer is readily found experimentally by sliding the dipole board over the feed board.

Figure 3:
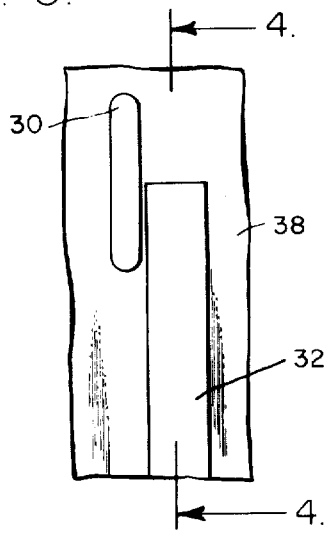
FIGS. 3 and 4 are front and side views, respectively, of a microstrip-dipole antenna element in accordance with the invention wherein the dipole is colinear, at the side, and centered longitudinally with respect to the microstrip line.
Figure 4:
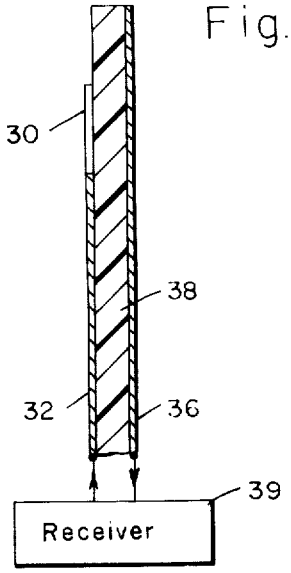

In the embodiment of FIGS. 3 and 4 the dipole is disposed colinear with, but at the side of, and centered longitudinally with respect to the microstrip feed line and the transfer of power between dipole 30 and the feed line 32 is both by means of electric and magnetic fields. In FIG. 4 a receiver unit 39 is shown coupled between the feed line 32 and metallic ground plane 36.

In the interest of clarity of explanation, sometimes the antenna elements and arrays are discussed herein as if they are transmitting devices, while in other instances they are considered as performing a receiving function. Of course it will be readily apparent to those skilled in the art that the elements and arrays in accordance with the subject invention function equally well as transmitting or receiving devices. To illustrate this point, the embodiment shown in FIG. 6 is coupled to a transmitting generator 40, while the embodiment of FIG. 4 is shown operating with a receiver. It should be understood that showing the embodiment of FIG. 4 with a receiver and that of FIG. 6 with a generator is not intended to imply that one embodiment works better as a receiving device while the other works better as a transmitting device, but rather to illustrate that the antenna elements in accordance with the subject invention operate in either mode. For example, a time shared receiver-transmitter unit with transmit-receive switching between operational modes may be utilized with the antenna elements of the subject invention.

In the embodiment of the invention shown in FIG. 5 dipole 30 is colinear with, disposed above, and only slightly overlaps the microstrip feed line and the coupling between the dipole and feed 32 line is almost entirely capacitive i.e., there are strong electric fields between the dipole and the feed line elements but essentially zero magnetic coupling.

Figure 7:
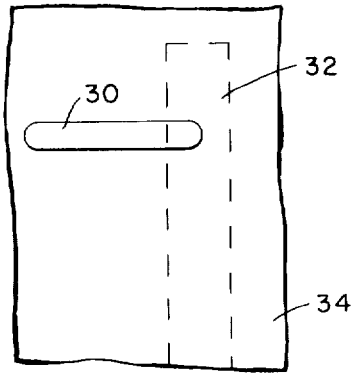
FIGS. 7 and 8 are front and side views, respectively, of a configuration of the invention wherein the dipole element is orthogonal to, above, and slightly overlaps the microstrip line.
Figure 8:
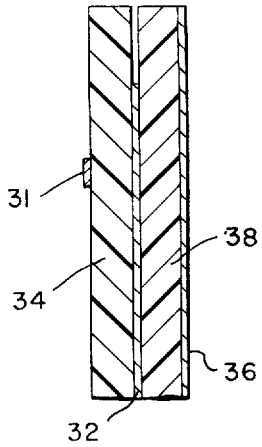

In the embodiment shown in FIGS. 7 and 8 dipole 30 is orthogonal to, disposed above and has only a small overlap with microstrip feed line 32, and the coupling is almost entirely by means of electric fields. The magnetic coupling is essentially zero due to the orthognal orientation of dipole 30 and the current flow in microstrip feed line 32.

Figure 9:
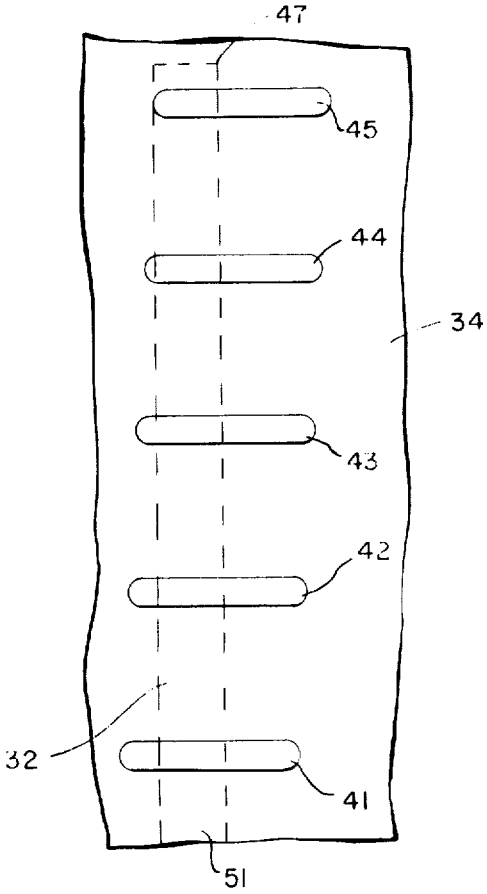
FIGS. 9 and 10 are front and side views, respectively, of a configuration wherein a plurality of dipole elements are reactively coupled to a single microstrip line such that a different degree of coupling for each of the dipole elements provides uniform radiation from each of the elements.
Figure 10:
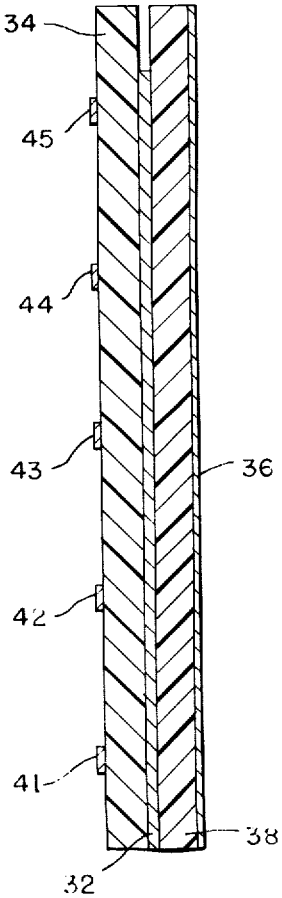

In the embodiment of FIGS. 9 and 10 dipoles 41 through 44 extract part of the power from the microstrip line and dipole 45 extracts most of the remaining power. The degree of coupling is controllable by adjusting the cross over position of the dipoles and the microstrip line; for example, the relative cross over of each of the dipoles may be arranged so that equal power is radiated by the dipoles to produce a "uniformly illuminated" linear array even though the power available to the dipoles closer to far end 47 of the feed line is less than the power at the dipoles nearer to feed source end 51. Hence, by varying the cross over position of the dipoles any desired illumination taper may be obtained. It is noted that the strongest coupling between the microstrip line and the dipole occurs at the end of the dipole, with minimum coupling occuring at the dipole center.

In the embodiment of FIGS. 9 and 10 dipoles 41–45 are orthogonally disposed with respect to microstrip line 32 and therefore the transfer of energy between the dipole and the microstrip line is almost entirely be means of the electric fields and very little or no energy is transferred by means of magnetic fields, i.e., the arrangement of FIGS. 9 and 10 employ substantially only capacitive coupling.

Figure 11:
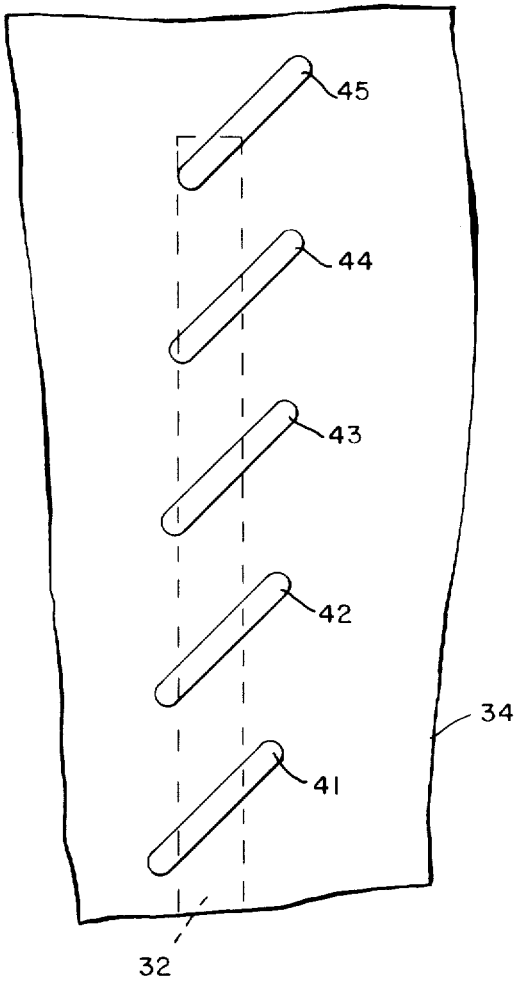
FIGS. 11 and 12 are front and side views, respectively, of a second configuration of dipole elements having different degrees of reactive coupling to a microstrip line.
Figure 12:
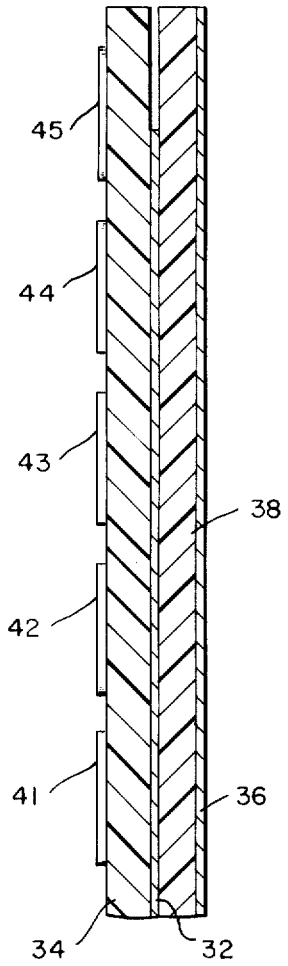
Figure 13:
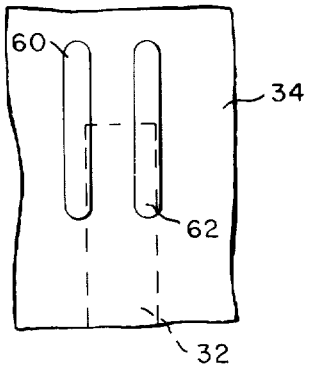
FIGS. 13 and 14 are front and side views, respectively, of an antenna element in accordance with the subject invention wherein two dipoles are disposed above, and are both electrically and magnetically coupled to each other and to a microstrip line.
Figure 14:
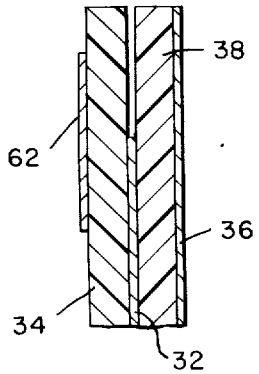

In the embodiment of FIGS. 11 and 12 the dipoles are disposed at a non-orthogonal angle with respect to the microstrip line 32 and consequently the transfer of energy is by means of both electric and the magnetic fields i.e., both capacitive and inductive coupling are employed.

Figure 15:
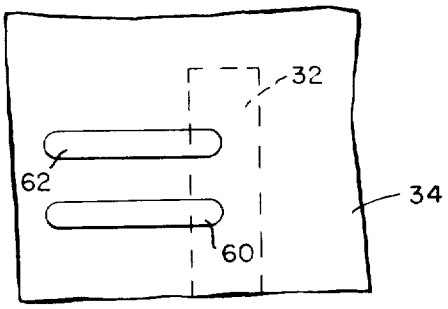
FIGS. 15 and 16 are front and side views, respectively, of a dipole pair which is capacitively coupled to the microstrip line.
Figure 16:
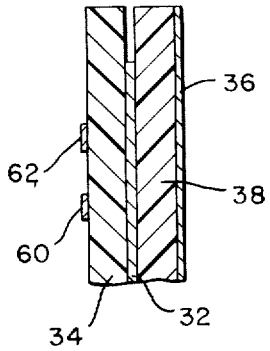
Figure 17:
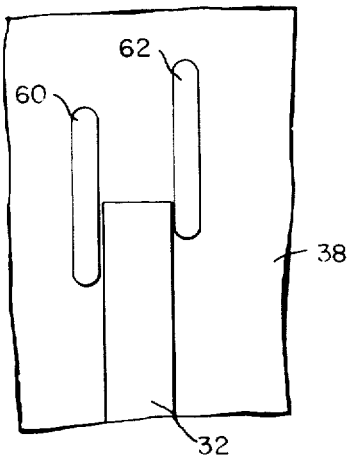
FIGS. 17 and 18 show an antenna arrangement in accordance with the subject invention which comprises a dipole pair disposed on the same board as the microstrip line.
Figure 18:
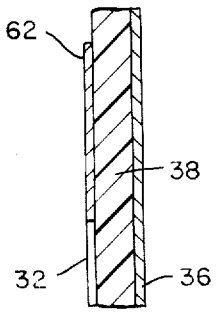

The embodiments of FIGS. 13 through 18 illustrate an aspect of the subject invention wherein two dipoles are coupled to one another and to microstrip line 32. In the embodiment shown in FIGS. 13 and 14 dipoles 60 and 62 are both electrically and magnetically coupled to microstrip line 32. In the embodiment of FIGS. 15 and 16 the two dipoles are orthogonally disposed with respect to microstrip lines 32 and therefore the energy transfer between the dipoles and the microstrip line is essentially by means of electric fields. In the embodiment of FIGS. 17 and 18 the dipole pair is formed on the same circuit board as microstrip line 32, otherwise the embodiment of FIGS. 17 and 18 are similar to those of FIGS. 13 and 14.

The primary advantage of the embodiments of the subject invention shown in FIGS. 13 through 18 is an increase in the bandwidth of the dipole antenna elements but some increase in the antenna gain is also achievable. For example, it is estimated that the dipole pair arrangement can achieve bandwidths of 13% compared to a bandwidth of about 8% for the single dipole embodiments. It is believed that the dipole pair arrangement is analogous to magnetically coupled inductor-capacitor resonant transformer circuits commonly used to couple the stages of an RF or IF amplifier. By properly adjusting the coupling between the two resonant parts of the IF transformer, a broadband "double humped" transmission response is obtained. In the above analogy, the microstrip transmission line forms one port of the transformer (antenna) and the other port is free space. A transmission response similar to an IF transformer response is obtained using the dipole pair shown in the embodiments of FIGS. 13 through 18.

In accordance with the subject invention the response of the dipole pair antenna element is easily adjustable by varying the positions of the pair of dipoles relatively to each other and relative to the microstrip line. There is no single unique position, but rather there are many such positions for satisfactory operation; and for a given position for one dipole there can be found a position for the other dipole which yields a good "double-humped" response. The dipoles are resonators which resonate at a frequency determined primarily by their length; and it has been found that best results are obtained by using dipoles of equal length, but acceptable results were also obtained having dipoles of different lengths. Also, although the primary improvement in gain and bandwidth are achieved by a pair of dipoles it is estimated that additional improvement may be obtained by arranging a larger number of dipoles such that there is an innercoupling between the dipoles as well as a coupling between the dipoles and the microstrip line.

Figure 19:
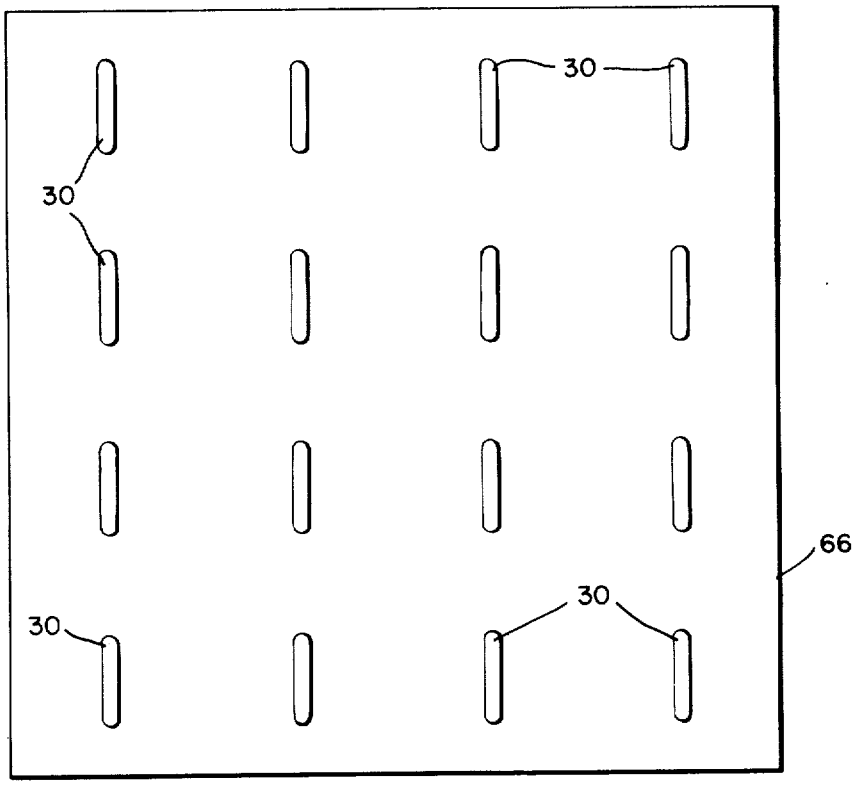
FIGS. 19 and 20 are plan views of a dipole board and a corporate feed circuit board, respectively, which are adapted for coating to form a planar array of microstrip-dipole antenna elements.
Figure 20:
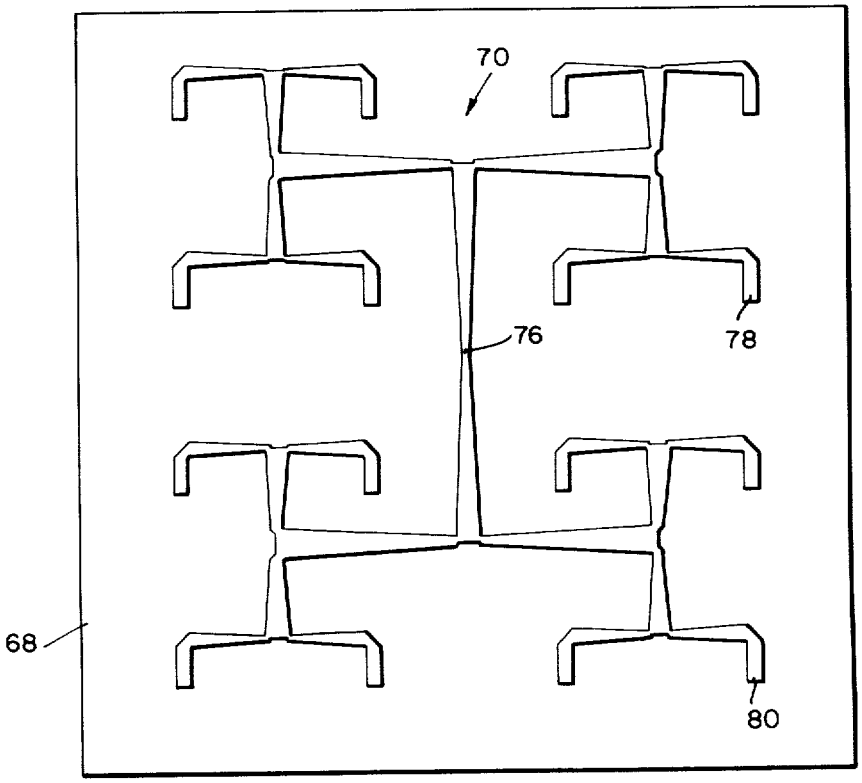
Figure 21:
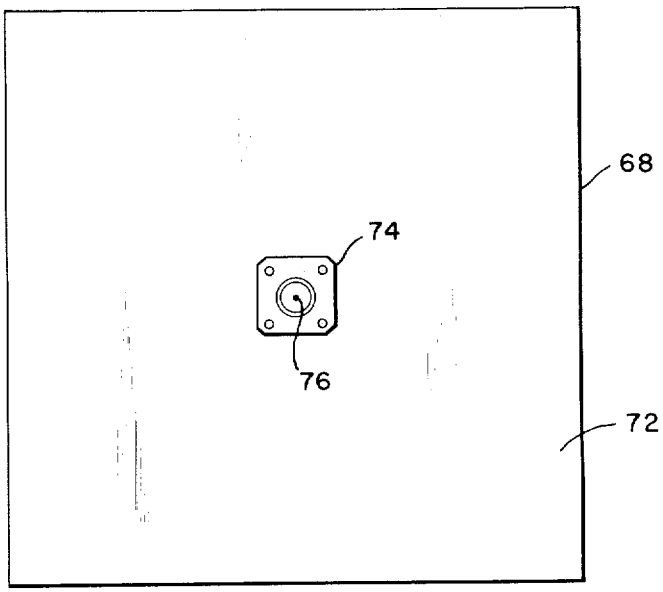
FIG. 21 is a rear perspective view of the corporate feed circuit board of FIG. 20.

In accordance with the invention, arrays of microstrip-dipole antenna elements of the type disclosed herein above, may be utilized to provide very thin antennas which may be of either the linear or the circular polarized configuration. FIGS. 19 through 21 illustrate a thin linearly polarized planar array. The antenna may be formed by sandwiching dipole board 66 with a corporate feed board 68, i.e. board 66 is placed on top of board 68 and the two are bonded together. The dipole board 66 shown in FIG. 19, may be reliably and economically produced by standard photoetching techniques whereby the dipole elements such as element 30, are formed by starting with a copper clad circuit board and photoetching away the material between the dipole elements. Similarly the electrical paths of corporate feed 70 (see FIG. 20) may be readily produced by photoetching the corporate feed distribution pattern on one side of microstrip board 68. As shown in FIG. 21 the other side of board 68 has a copper coating 72.

In an embodiment of FIGS. 19 through 21 the power applied to or received by the array is routed to or from the antenna by means of microwave connector 74, the outer conductor (case) of which is in contact with the metal ground plane 72 and the inner connector is in electrical contact with the corporate feed at a junction point 76 (see FIG. 20). The path lengths from the feed point 76, to each end of the corporate feed network, such as 78 or 80, preferably are equal so as to provide a constant antenna beam pointing direction over a wide bandwidth.

Boards 66 and 68 may be sandwiched together so that each dipole and its associated microstrip line of the corporate feed arrangement form an antenna element of the type shown in FIGS. 1 and 2 or FIGS. 3 and 4, for example. To implement antenna elements of the type shown in FIGS. 7 and 8, board 66 is rotated in the plane of the drawing 90° from the position shown in FIG. 19 and then placed on top of board 68 in such a manner that the arrangement of FIGS. 7 and 8 is obtained for each dipole. Further, very thin linear arrays of antenna elements of the type shown in FIGS. 3 and 4 may be readily implemented by forming the dipole element associated with each feed distribution end portion, for example end portion 78, on corporate feed board 68. A planar array having increased bandwidth may be implemented by using the multiple dipole configuration disclosed herein relative to FIGS. 13 through 18 and an array similar to that of FIGS. 19–21.

Figure 22:
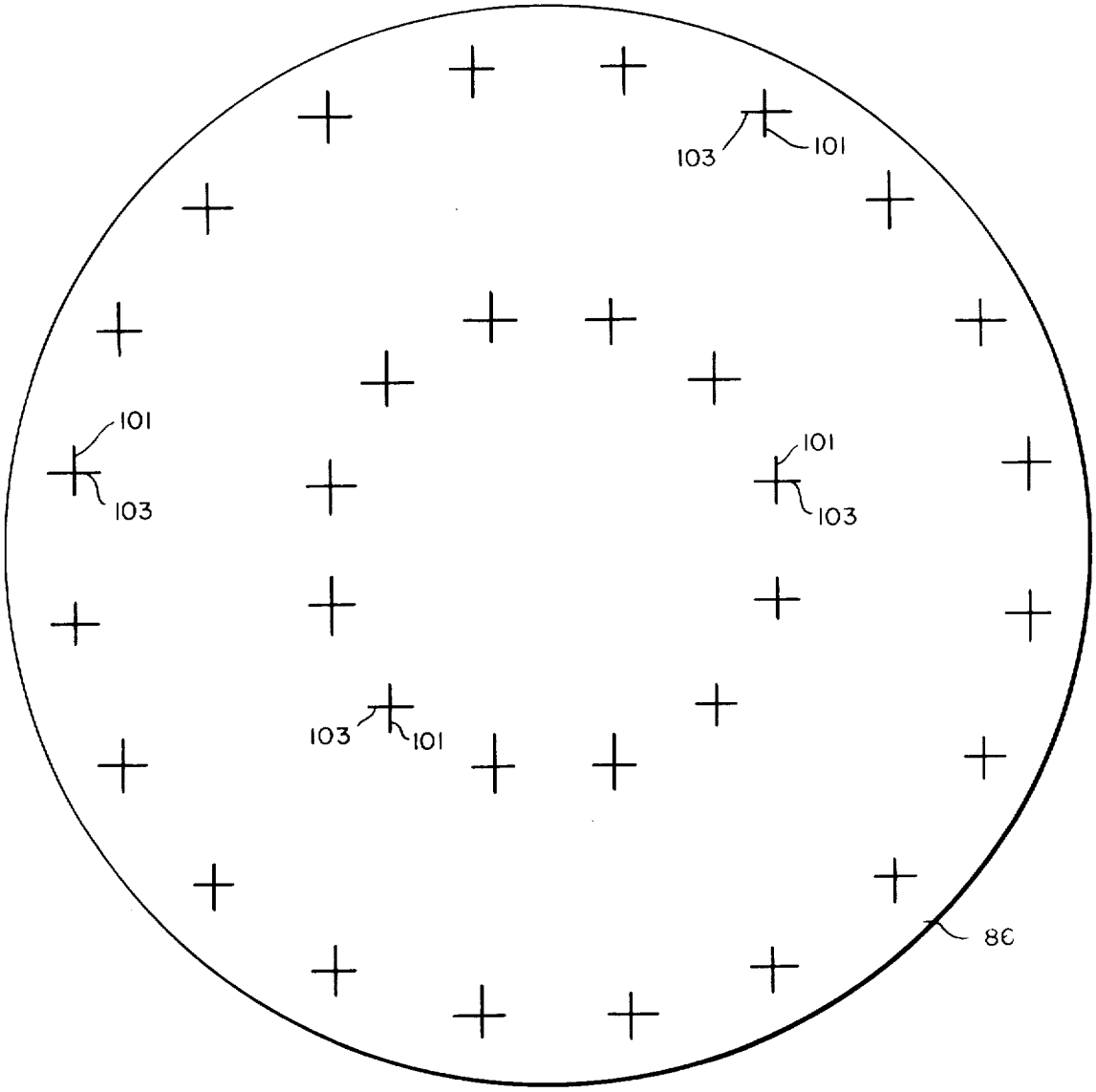
FIGS. 22 and 23 are top plan views of a dipole board and a corporate feed microstrip board, respectively, which are adapted for coacting so as to provide a circularly polarized antenna array.
Figure 23:
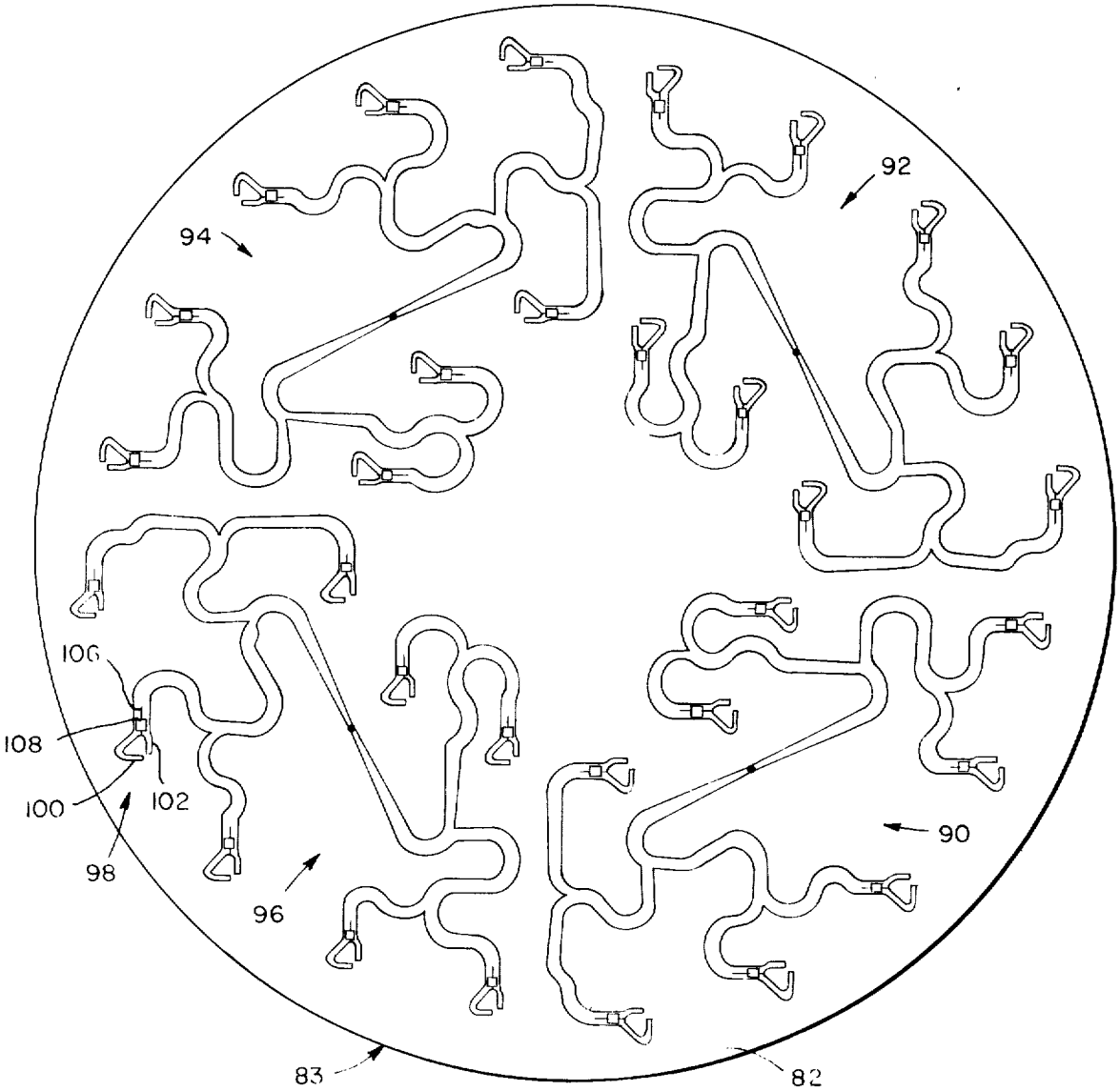
Figure 24:
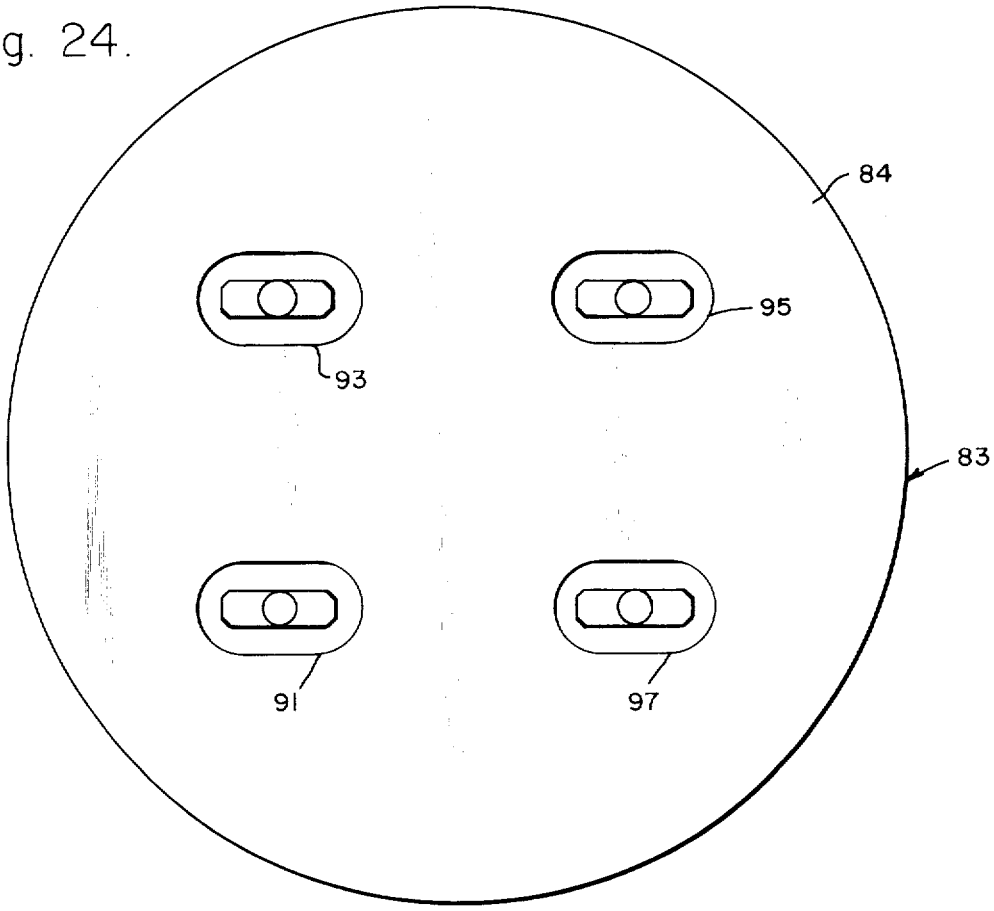
FIG. 24 is a bottom plan view of the corporate feed board of FIG. 23.

A circularly polarized antenna in accordance with the principles of the subject invention is illustrated in FIGS. 22 through 25 to which reference is now primarily directed. FIG. 23 shows one side of a microstrip board 83 on which is formed a four quadrant corporate feed structure adapted for "monopulse" operation. The four segments or quadrants of the corporate feed structure are designated generally by reference numerals 90, 92, 94 and 96. Referring now primarily to FIGS. 23 and 24, the corporate feed quadrant 90 is operatively coupled to microwave connector 91 in such a manner that microwave energy may be supplied to and received from the corporate feed arrangement; similarly corporate feed quadrants 92, 94 and 96 are operatively intercoupled with microwave connectors 93, 95 and 97, respectively.

The corporate feed structure on surface 82 of board 83 may be readily produced by standard photoetching techniques whereby a copper clad surface of the board is etched away to leave the illustrated pattern. The rear side 84 (see FIG. 24) of board 83 has a copper clad surface and the outer conductors of the microwave connectors are electrically connected to the copper clad surface. The inner conductor, such as conductor 89 associated with connector 91, is connected to the central point, such as junction 87 (see FIG. 23), of the associated corporate feed quadrant.

Figure 25:
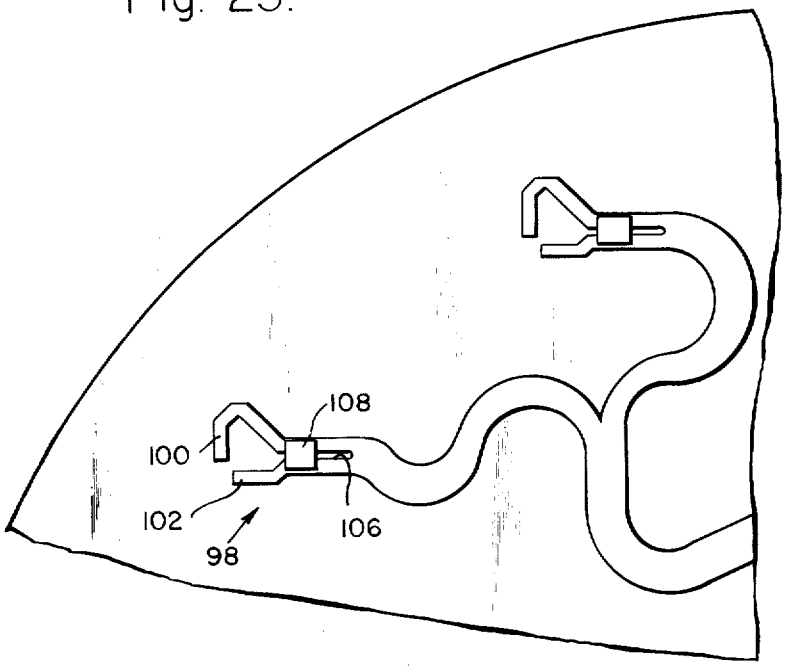
FIG. 25 shows a portion of the corporate feed board of FIG. 23 in greater detail, including resistive paint used to form a load for the fourth port of a four port junction.

Each electrical path of the corporate feed assembly is terminated in a "claw" type structure, such as that indicated by reference numeral 98, and comprises two orthogonally disposed arm members such as 100 and 102 (see FIG. 25). Associated with each claw structure of the corporate feed assembly is a pair of orthogonally disposed dipole elements on dipole board 86 of FIG. 22. The dipole elements on board 86 may be formed by the photoetching technique discussed previously and the pattern of these elements is such that one dipole of each pair is operatively associated with one of the arms of each claw structure in the corporate feed assembly. For example dipole 101 is operatively coupled to arm 100 and dipole 103 with arm 102 (see FIG. 25). The length of arm 100 is a quarter of a wavelength greater than the length of arm 102, and hence the signals radiated by dipoles 101 and 103 are in phase quadrature, and since the dipoles are spatially in quadrature, the two conditions for producing circularly polarized energy are implemented.

Figure 26:
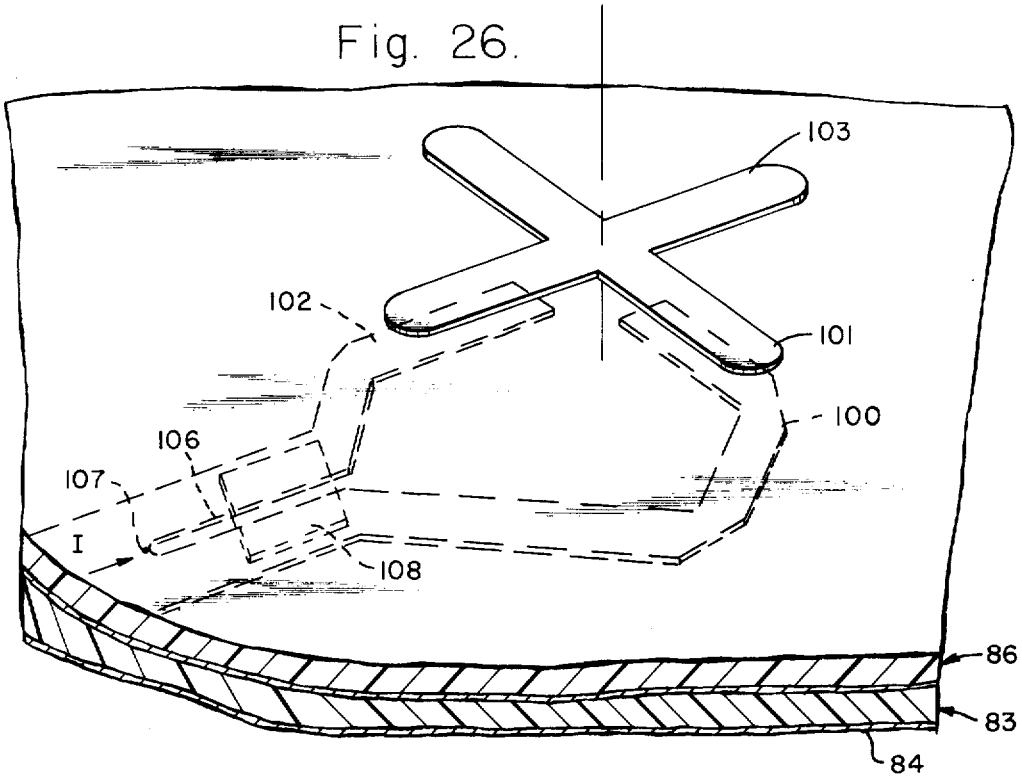
FIG. 26 is a diagram of a pair of dipole elements and the associated corporate microstrip board of the embodiment of FIGS. 22–24.

Referring now to FIG. 26 and considering the situation where the antenna element thereshown is in a transmit mode of operation, current supplied to the element divides at slot 106, with half of the current going to the short line 102 of the claw feed and the other half going to the long line 100. A resistor 108 is painted across slot 106 in accordance with conventional printed circuit techniques. It is noted that the applied energy on both sides of slot 106 is substantially in phase and hence there is no potential across resistor 1–8 and no tendency for current flow therein. However energy reflected from the end portions of arms 100 and 102 are 180° out of phase at resistor 108, this being due to the 90° difference in the length of the two paths, and hence resistor 108 serves the function of dissipating undesirable energy reflections from the ends of the claw feed.

Figure 27:
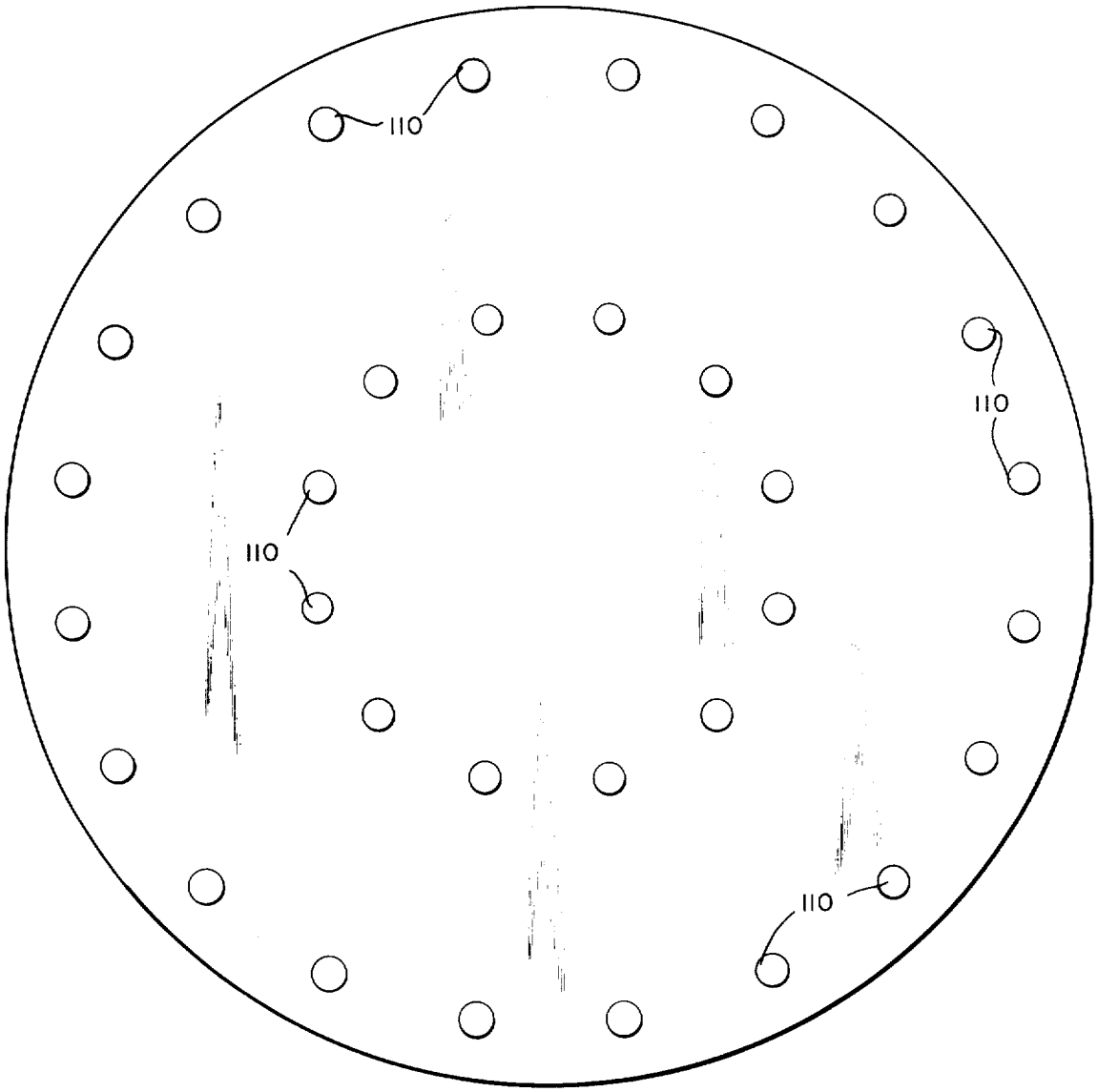
FIG. 27 is a plan view of a second embodiment of the dipole board of FIG. 22 wherein the dipole pairs are implemented by disk shaped conductive elements.

FIG. 27 illustrates a variation to the circularly polarized antenna configuration of FIGS. 21 through 26 in as much as each of the dipole pairs, such as 101, and 103 of FIG. 22, are replaced by a circular disk, such as 110. For some applications the disk configuration is preferred because of economies in manufacture and improved structural stability; however functionally the description herein pertaining to the antenna of FIGS. 21 through 26 is applicable to the "disk" variations thereof.

In the operation of the above disclosed circularly polarized antenna, the two metal strips such as 101 and 103 are individually coupled to terminals of an associated claw feed such arms 100 and 102, respectively; and the corporate feed excites signals at the respective dipoles which are approximately of equal magnitude but differ in phase by 90°. Since the dipoles of each pair are perpendicular to one another and are excited at a 90° phase difference, circularly polarized signals are radiated; with the direction of maximum radiated power being perpendicular to the plane of the dipoles.

The corporate feed assembly uses microstrip transmission lines, i.e., strip conductors separated from a ground plane by a dielectric, and for operation at X-band frequencies the corporate feed dielectric board is approximately 0.032 inch thick. The dipole pairs are formed on a printed circuit board of approximately 0.055 inch thickness; and the total thickness of the antenna is approximately 1/15th of a wavelength. It is noted that the thickness of either board can be substantially varied from the above specified dimensions and still maintain adequate performance.

In the embodiment of FIGS. 22 through 26 the metal dipole strips of each dipole pair are joined at their center for convenience of manufacture, and with this arrangement symmetry in the coupling between each dipole and its associated corporate feed is preferred so that the currents in the dipoles are balanced and "cross talk" effects are minimized.

As noted above, the claw structure such as 98, (see FIG. 26) incorporates a 4-port power divider arrangement which helps to obtain broad bandwidth capabilities. The resistor, e.g. 108, associated with each claw feed structure terminates the 4th port so as to absorb "mismatch power" reflected from the end of the feed arms. Without this resistive termination, the reflected power disturbs the amplitude and phase equality at the junction of the power divider and results in a degradation of the circular polarization axial rato at frequencies off resonance. With the resistive termination, good circular polarized operation is obtainable over a 15% bandwidth, for example.

Microstrip-dipole circular polarized antenna arrays in accordance with the subject invention are advantageous inasmuch as they can be very thin, for example 1/15th of a wavelength; they are relatively inexpensive to manufacture; they have relatively high efficiency, such as 75%; and they are adapted for high quality, high reliability fabrication. Relative to this last benefit, since the antenna may be constructed from two printed boards the exact and reproducible dimensions with which circuit boards can be fabricated permit the achievement, and retention during production, of high quality antennas.

Thus having disclosed new and useful microstrip-dipole antenna elements and arrays thereof, what is claimed is:

1. An antenna element comprising:

a microstrip board having a conductive feed line on a first side thereof and a conductive surface on its second side; and at least one conductive dipole separated from said conductive surface by less than one-sixth of a wavelength of the antenna element's operational frequency as measured in the medium between said dipole and said conductive surface, and with said at least one dipole being spaced apart from and asymmetrically disposed relative to said feed line such that one end portion of said dipole overlaps said feed line and the remaining portion of said dipole does not overlap said feed line and with said asymmetrical orientation of said dipole being sufficient to cause substantially different amounts of reactive coupling between the feed line and the respective end portions of the dipole; whereby signals can be applied or received across said feed line and said conductive surface.

2. The antenna element of claim 1 wherein said dipole is disposed above and is parallel to said feed line.

3. The antenna element of claim 2 wherein said dipole is longitudinally centered with respect to one end of said feed line.

4. The antenna element of claim 2 wherein said dipole is disposed relative to one end of said feed line such that the longitudinal overlap therebetween is at least one-thirtieth of a wavelength of the antenna's operational frequency.

5. The antenna element of claim 1 wherein said dipole is on a dielectric board which is disposed relative to said microstrip board such that said dipole is separated from said feed line by the thickness of said dielectric board.

6. The antenna element of claim 5 wherein said dipole is parallel to and longitudinally centered with respect to one end of said microstrip feed line.

7. The antenna element of claim 6 wherein the combined thickness of said dielectric and microstrip boards is between $\lambda/6$ and $\lambda/25$, where $\lambda$ is the wavelength of the antenna element's operational frequency.

8. The antenna element of claim 7 wherein the thickness of said microstrip board is between $\lambda/16$ and $\lambda/50$.

9. The antenna element of claim 7 wherein the combined thickness of said dielectric and microstrip boards is approximately 2.7 times the thickness of said microstrip board.

10. The antenna element of claim 1 wherein said dipole is above and orthogonal to said feed line, whereby the reactive coupling between said dipole and said feed line is predominantly capacitive.

11. The antenna of claim 1 wherein said dipole is on said first side of said microstrip board and adjacent to said feed line.

12. The antenna element of claim 11 wherein said dipole is parallel to, located at the side of, and is centered longitudinally with respect to one end of said feed line.

13. The antenna element of claim 11 wherein said dipole is disposed relative to one end of said feed line such that there is a longitudinal overlap therebetween of at least one-thirtieth of a wavelength of the operational frequency of said antenna element.

14. An antenna element comprising:

a microstrip board having a conductive feed line on a first side thereof and a conductive surface on its second side; and at least two conductive dipoles reactively coupled to one another and space apart from and asymmetrically disposed relative to said feed line such that one end portion of each dipole overlaps said feed line and the remaining portion of each dipole does not overlap said feed line and with said asymmetrical orientation of each dipole being sufficient to cause substantially different amounts of reactive coupling between the feed line and the respective end portions of each dipole, and said dipoles being separated from said conductive surface by less than one-sixth of a wavelength of the element's operational frequency, as measured in the medium between said dipoles and said conductive surface.

15. The antenna element of claim 14 wherein said dipoles are on a dielectric board which is disposed on top of said microstrip board such that said dipoles are separated from said feed line by the thickness of said dielectric board, and wherein the combined thickness of said dielectric and microstrip boards is between $\lambda/6$ and $\lambda/25$, where $\lambda$ is the wavelength of the antenna element's operational frequency.

16. The antenna element of claim 15 wherein the thickness of said microstrip is between $\lambda/16$ and $\lambda/50$.

17. The antenna element of claim 14 wherein said dipoles are disposed above and are parallel to said feed line.

18. The antenna element of claim 14 wherein said dipoles are longitudinally centered with respect to one end of said feed line.

19. The antenna element of claim 14 wherein said dipoles are disposed relative to one end of said feed line such that the longitudinal overlap between each of said dipoles and said end is at least one-thirtieth of a wavelength of the antenna's operational frequency.

20. The antenna element of claim 14 wherein said dipoles are above and orthogonal to said feed line, whereby the coupling between said dipoles and said feed line is predominately capacitive.

21. The antenna element of claim 14 wherein said dipoles are on said first side of said microstrip board and on opposite sides of said feed line.

22. The antenna element of claim 21 wherein the dipoles are centered longitudinally with respect to one end of said feed line.

23. A linear antenna array comprising:

a microstrip board having a conductive feed line on a first side thereof and a conductive surface on its second side; and a plurality of conductive dipole elements each of which is spaced apart from and asymmetrically disposed relative to said feed line such that one end portion of each dipole overlaps said feed line and the remaining portion of each dipole does not overlap said feed line and with said asymmetrical orientation of each dipole being sufficient to cause substantially different amounts of reactive coupling between the feed line and the respective end portions of each dipole and said dipoles being separated from said conductive surface by less than one-sixth of a wavelength of the array's operational frequency, as measured in the medium between said dipoles and said conductive surface;

whereby the illumination taper of the array is determined by the relative coupling pattern between said dipoles and said feed line; and signals can be applied or received across said feed line and said conductive surface.

24. The linear antenna array of claim 23 wherein said plurality of dipoles are orthogonal to said feed line, whereby the reactive coupling between said dipoles and said feed line is predominately capacitive.

25. The linear antenna array of claim 23 wherein said plurality of dipoles are on a dielectric board which is disposed on top of said microstrip board such that said dipoles are separated from said feed line by the thickness of said dielectric board.

26. A planar array antenna comprising:

a microstrip board having on a first side thereof a corporate feed arrangement comprising interconnected conductive feed lines arranged so that ends of the feed lines form a preselected pattern, and having a conductive surface on its second side;

a dielectric board having an array of conductive dipole elements arranged in the same pattern as said ends of the feed lines; and wherein said dielectric board is disposed on top of said microstrip board such that each of said dipoles are separated from an associated feed line by the thickness of said dielectric board, such that each of said dipoles is spaced apart from and asymmetrically disposed relative to its associated feed line such that one end portion of each dipole overlaps said feed line and the remaining portion of each dipole does not overlap said feed line and with said asymmetrical orientation of each dipole being sufficient to cause substantially different amounts of reactive coupling between the feed line and the respective end portions of each dipole and wherein the thickness of said microstrip and dielectric boards are such that said dipoles elements are separated from said conductive surface by less than one-sixth of a wavelength of the array's operational frequency, as measured in the medium between said dipole and said conductive surface; whereby signals can be applied or received across said corporate feed arrangement and said conductive surface.

27. The antenna of claim 26 wherein each of said dipoles are colinear with respect to the end of its associated feed line.

28. The antenna of claim 27 wherein each of said dipoles is longitudinally centered with respect to the end of its associated feed line.

29. An antenna element adapted for transmitting circularly polarized signals comprising:

a microstrip board having on a first side thereof a conductive feed line, one end of which terminates into mutually orthogonal arms and with one arm being approximately a quarter of a wavelength of the antenna element's operational frequency longer than the other arm; and having a conductive surface on its second side and wherein a portion of said feed line contiguous to said arms is slotted and a resistive material bridges said slot; whereby during the operation of said antenna, energy reflected from the ends of said arms is dissipated by said resistive material;

a dielectric board having a pair of mutually orthogonal conductive dipoles; and wherein said dielectric board is disposed relative to said microstrip board such that said dipoles are separated from said feed line by the thickness of said dielectric board and so that each of said dipoles is reactively coupled to an associated one of the arms of said feed line; whereby circularly polarized signals can be applied or received across said feed line and said conductive surface.

30. A circularly polarized antenna comprising:

a microstrip board having on a first side thereof a corporate feed arrangement comprising interconnected conductive feed lines, with one end of each feed line terminating in two mutually orthogonal arms and with one arm of each line being approximately 90° longer than the other arm at the antenna's operational frequency; and having a conductive surface on its second side;

a dielectric board having a plurality of pairs of mutually orthogonal conductive dipoles arranged in the same pattern as the ends of the feed lines on said microstrip board; and wherein;

said dielectric board is disposed relative to said microstrip board such that said dipoles are separated from said corporate feed arrangement by the thickness of said dielectric board and so that each of said dipoles is reactively coupled to an associated one of the arms of an associated feed line; whereby circularly polarized signals can be transmitted or received by applying or receiving signals across said corporate feed arrangement and said conductive surface.

31. The antenna of claim 30 wherein a portion of each of said feed lines contiguous to said arms is slotted and a resistive material bridges said slot; whereby during the operation of said antenna, energy reflected from the end of said arms is dissipated by said resistive material.

32. The antenna of claim 30 wherein each of said dipoles is colinear with respect to the associated arm of said corporate feed arrangement.

33. The antenna arrangement of claim 32 wherein each of said dipoles is longitudinally centered with respect to the end of the associated arm of said corporate feed arrangement.

34. A circularly polarized antenna comprising:

a microstrip board having on a first side thereof a corporate feed arrangement comprising interconnected conductive feed lines, with one end of each feed line terminating in two mutually orthogonal arms and with one arm of each line being approximately 90° longer than the other arm at the antenna's operating frequency; and having a conductive surface on its second side and wherein a portion of each of said feed lines contiguous to said arms is slotted and a resistive material bridges said slot; whereby during the operation of said antenna, energy reflected from the ends of said arms is dissipated by said resistive material;

a dielectric board having a plurality of disk shaped conductors arranged thereon in the same pattern as the ends of the feed lines on said microstrip board; and wherein said dielectric board is disposed relative to said microstrip board such that said disk shaped conductors are separated from said corporate feed arrangement by the thickness of said dielectric board and so that each of said disk shaped conductors is reactively coupled to the arms of an associated feed line; whereby circularly polarized signals can be applied or received by applying or receiving signals across said corporate feed arrangement and said conductive surface.

* * * * *